US010964267B2

(12) United States Patent
Park et al.

(10) Patent No.: US 10,964,267 B2
(45) Date of Patent: Mar. 30, 2021

(54) PIXEL AND DISPLAY DEVICE HAVING THE SAME

(71) Applicant: Samsung Display Co., LTD., Yongin-si (KR)

(72) Inventors: Jun-Hyun Park, Suwon-si (KR); Young-Wan Seo, Suwon-si (KR); An-Su Lee, Seoul (KR); Bo-Yong Chung, Suwon-si (KR); Kang-Moon Jo, Hwaseong-si (KR); Chong-Chul Chai, Seoul (KR)

(73) Assignee: SAMSUNG DISPLAY CO., LTD., Yongin-si (KR)

( * ) Notice: Subject to any disclaimer, the term of this patent is extended or adjusted under 35 U.S.C. 154(b) by 0 days.

(21) Appl. No.: 16/877,816

(22) Filed: May 19, 2020

(65) Prior Publication Data

US 2020/0279532 A1 Sep. 3, 2020

Related U.S. Application Data

(63) Continuation of application No. 15/726,472, filed on Oct. 6, 2017, now Pat. No. 10,665,166.

(30) Foreign Application Priority Data

Feb. 9, 2017 (KR) ..... 10-2017-0017961

(51) Int. Cl.
*G09G 3/3258* (2016.01)
*G09G 3/3233* (2016.01)
(Continued)

(52) U.S. Cl.
CPC ..... *G09G 3/3258* (2013.01); *G09G 3/3233* (2013.01); *G09G 3/3266* (2013.01); *G09G 3/3275* (2013.01); *G09G 2300/0426* (2013.01); *G09G 2300/0814* (2013.01); *G09G 2300/0819* (2013.01); *G09G 2300/0842* (2013.01); *G09G 2300/0852* (2013.01); *G09G 2310/08* (2013.01); *G09G 2320/0214* (2013.01);
(Continued)

(58) Field of Classification Search
CPC combination set(s) only.
See application file for complete search history.

(56) References Cited

U.S. PATENT DOCUMENTS

2006/0044244 A1 3/2006 Numao
2014/0347401 A1 11/2014 Hwang et al.
(Continued)

FOREIGN PATENT DOCUMENTS

KR 10-2014-0123219 10/2014

*Primary Examiner* — Robin J Mishler
(74) *Attorney, Agent, or Firm* — Kile Park Reed & Houtteman PLLC

(57) ABSTRACT

A pixel includes first, second, and third transistors, first and second capacitors, and an organic light emitting diode. The first transistor has a gate electrode connected to a first node, a first electrode that receives a first power voltage, and a second electrode connected to a second node. The second transistor has a gate electrode that receives a scan signal, a first electrode connected to the first node, and a second electrode connected to a third node. The third transistor has a gate electrode that receives a common control signal, a first electrode connected to the third node, and a second electrode connected to the second node. The organic light emitting diode has a first electrode connected to the second node and a second electrode that receives a second power voltage.

15 Claims, 17 Drawing Sheets

(51) Int. Cl.
*G09G 3/3266* (2016.01)
*G09G 3/3275* (2016.01)

(52) U.S. Cl.
CPC ..... *G09G 2320/0233* (2013.01); *G09G 2320/064* (2013.01); *G09G 2330/021* (2013.01)

(56) References Cited

U.S. PATENT DOCUMENTS

| | | | |
|---|---|---|---|
| 2016/0203759 | A1 | 7/2016 | Han |
| 2016/0275869 | A1 | 9/2016 | Hwang et al. |
| 2018/0061868 | A1 | 3/2018 | Na et al. |

PIXEL AND DISPLAY DEVICE HAVING THE SAME

CROSS REFERENCE TO RELATED APPLICATION

This is a continuation application based on currently pending U.S. patent application Ser. No. 15/726,472, filed on Oct. 6, 2017, the disclosure of which is incorporated herein by reference in its entirety. U.S. patent application Ser. No. 16/514,582 claims priority benefit of Korean Patent Application No. 10-2017-0017961, filed on Feb. 9, 2017 in the Korean Intellectual Property Office, the disclosure of which is incorporated herein by reference in its entirety for all purposes.

BACKGROUND

1. Field

One or more embodiments described herein relate to a display device and pixel.

2. Description of the Related Art

An organic light emitting display generates images based on light emitted from organic light emitting diodes. Each organic light emitting diode includes an organic layer between an anode and a cathode. Light is emitted when holes from the anode combine with electrons from the cathode in the organic layer.

Various factors may adversely affect the performance of these displays. One factor relates to differences in the threshold voltages of pixel driving transistors caused by manufacturing process variations. This may produce luminance deviations. In an attempt to solve this problem, various pixel structures have been developed to compensate the differences in threshold voltages of driving transistors.

Additionally, an organic light emitting display may drive pixels in a simultaneous emission manner in order to prevent motion blur or other effects. However, when the pixels have a relatively complicated structure for compensating the threshold voltages of driving transistors or for being driven in a simultaneous emission manner, it may be difficult to manufacture displays with high-resolution.

SUMMARY

In accordance with one or more embodiments, a display device includes a display panel including a plurality of pixels; and a panel driver to provide a scan signal to the pixels via a plurality of scan lines and to provide data signals to the pixels via a plurality of data lines, wherein each of the pixels includes: a first transistor including a gate electrode connected to a first node, a first electrode connected to a first power source, and a second electrode connected to a second node; a second transistor including a gate electrode connected to one of the scan lines, a first electrode connected to the first node, and a second electrode connected to the second node; an organic light emitting diode including a first electrode connected to the second node and a second electrode connected to a second power source; a first capacitor including a first electrode connected to a third power source and a second electrode connected to the first node; and a second capacitor including a first electrode connected to one of the data lines and a second electrode connected to the second node.

The panel driver may drive the display panel in a simultaneous emission manner, each frame including a non-emission period during which the pixels do not emit light and an emission period during which the pixels are to simultaneously emit light, and for each of the pixels, the non-emission period sequentially includes a first initialization period during which the first electrode of the organic light emitting diode is to be initialized, a second initialization period during which the gate electrode of the first transistor is to be initialized, a threshold voltage compensation period during which a diode connection of the first transistor is to be formed, and a data writing period during which the data signal is to be provided to the pixel.

The first transistor may be a n-channel Metal-Oxide-Semiconductor (nMOS) transistor, a voltage level of the first power source may correspond to one of a first voltage level, a second voltage level greater than the first voltage level, or a third voltage level greater than the second voltage level, and a voltage level of the third power source may correspond to one of a fourth voltage level or a fifth voltage level greater than the fourth voltage level.

During the first initialization period, the first power source may have the second voltage level, the third power source may have the fifth voltage level greater than the second voltage level, and the scan signal may have an off-level.

During the second initialization period, the first power source may have the second voltage level, the third power source may have the fifth voltage level, and the scan signal may have an on-level.

During the threshold voltage compensation period, the first power source may have the first voltage level, the third power source may have the fourth voltage level, and the scan signal may have an on-level.

During the data writing period, the first power source may have the second voltage level, the third power source may have the fourth voltage level, and the panel driver may progressively provide the scan signal having an on-level to the scan lines to program data signals in the pixels.

During the emission period, the first power source may have the third voltage level, the third power source may have the fifth voltage level, and the scan signal may have an off-level.

The first transistor may be a p-channel Metal-Oxide-Semiconductor (pMOS) transistor, a voltage level of the first power source may correspond to one of a first voltage level, a second voltage level greater than the first voltage level, or a third voltage level greater than the second voltage level, a voltage level of the third power source may correspond to one of a fourth voltage level or a fifth voltage level greater than the fourth voltage level, and a voltage level of the second power source may correspond to one of a sixth voltage level or a seventh voltage level greater than the sixth voltage level.

During the first initialization period, the first power source may have the first voltage level, the third power source may have the fourth voltage level, the second power source may have the seventh voltage level, and the scan signal may have an off-level.

During the second initialization period, the first power source may have the first voltage level, the third power source may have the fourth voltage level, the second power source has the seventh voltage level, and the scan signal may have an on-level.

During the threshold voltage compensation period, the first power source may have the third voltage level, the third power source may have the fifth voltage level, the second power source may have the seventh voltage level, and the scan signal may have an on-level.

During the data writing period, the first power source may have the second voltage level, the third power source may have the fifth voltage level, the second power source has the seventh voltage level, and the panel driver may progressively provide the scan signal having an on-level to the scan lines to program the data signals in the pixels.

During the emission period, the first power source may have the third voltage level, the third power source may have the fifth voltage level, the second power source may have the sixth voltage level, and the scan signal may have an off-level. The non-emission period may include a third initialization period between the data writing period and the emission period, and a voltage level of the third power source may swing during the third initialization period. The first transistor and the second transistor may be different types of metal-oxide-semiconductor (MOS) transistors.

In accordance with one or more other embodiments, a pixel includes a first transistor including a gate electrode connected to a first node, a first electrode connected to a first power source, and a second electrode connected to a second node; a second transistor including a gate electrode connected to a scan line, a first electrode connected to the first node, and a second electrode connected to the second node; an organic light emitting diode including a first electrode connected to the second node and a second electrode connected to a second power source; a first capacitor including a first electrode connected to a third power source and a second electrode connected to the first node; and a second capacitor including a first electrode connected to a data line and a second electrode connected to the second node. The first transistor and the second transistor may be different types of metal-oxide-semiconductor (MOS) transistors.

In accordance with one or more other embodiments, a pixel includes a first transistor including a gate electrode connected to a first node, a first electrode connected to a first power source, and a second electrode connected to a second node; a second transistor including a gate electrode connected to a first scan line, a first electrode connected to a first node, and a second electrode connected to a third node; a third transistor including a gate electrode connected to a second scan line, a first electrode connected to the third node, and a second electrode connected to the second node; an organic light emitting diode including a first electrode connected to the second node and a second electrode connected to a second power source; a first capacitor including a first electrode connected to a third power source and a second electrode connected to the first node; and a second capacitor including a first electrode connected to a data line and a second electrode connected to the third node. The second transistor is a low temperature poly silicon (LTPS) thin film transistor, and the third transistor is an oxide thin film transistor.

BRIEF DESCRIPTION OF THE DRAWINGS

Features will become apparent to those of skill in the art by describing in detail exemplary embodiments with reference to the attached drawings in which.

DETAILED DESCRIPTION

Figure 1:
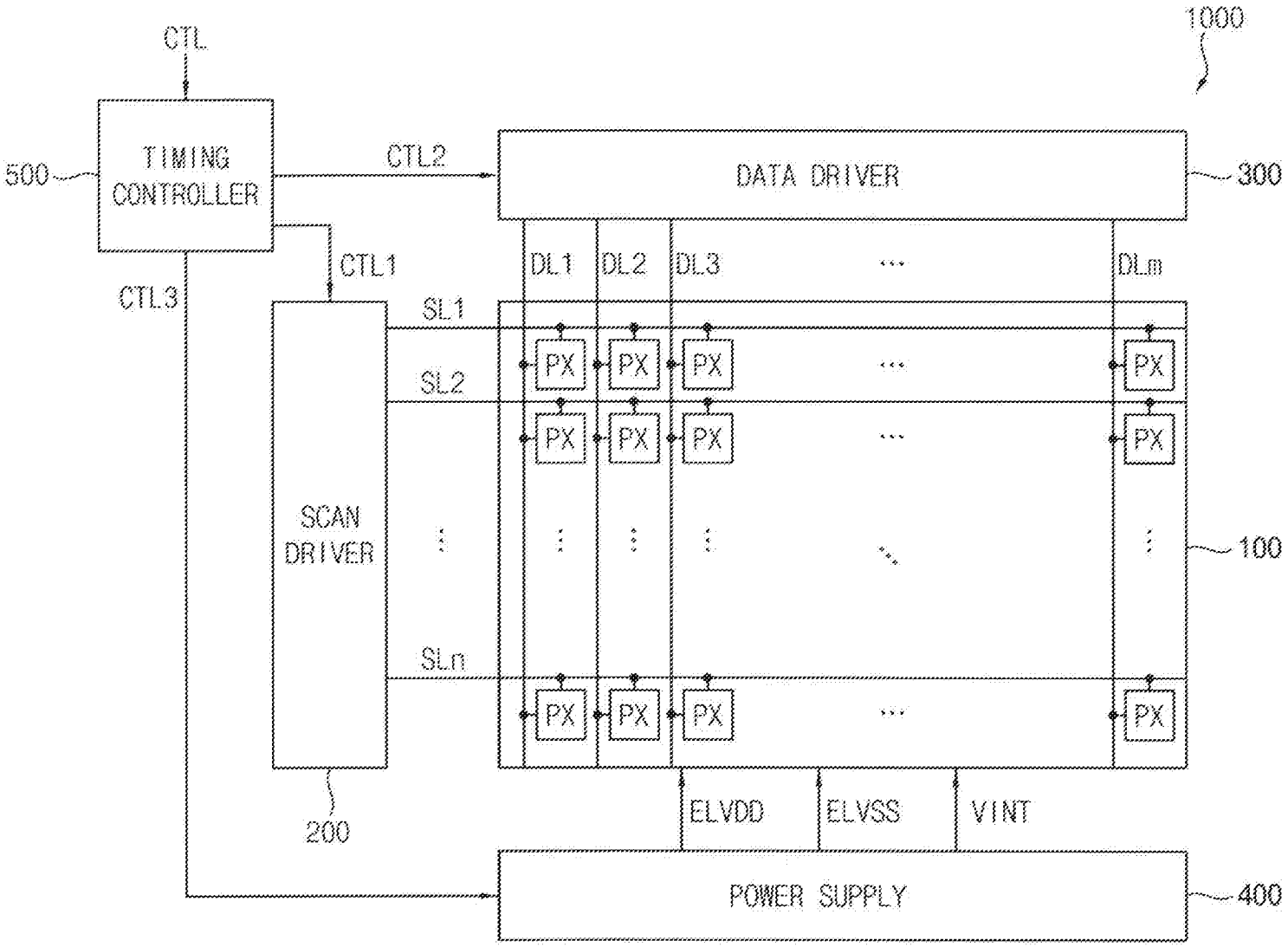
FIG. 1 illustrates an embodiment of a display device.

Example embodiments are described with reference to the drawings; however, they may be embodied in different forms and should not be construed as limited to the embodiments set forth herein. Rather, these embodiments are provided so that this disclosure will be thorough and complete, and will convey exemplary implementations to those skilled in the art. The embodiments (or portions thereof) may be combined to form additional embodiments In the drawings, the dimensions of layers and regions may be exaggerated for clarity of illustration. It will also be understood that when a layer or element is referred to as being "on" another layer or substrate, it can be directly on the other layer or substrate, or intervening layers may also be present. Further, it will be understood that when a layer is referred to as being "under" another layer, it can be directly under, and one or more intervening layers may also be present. In addition, it will also be understood that when a layer is referred to as being "between" two layers, it can be the only layer between the two layers, or one or more intervening layers may also be present. Like reference numerals refer to like elements throughout.

When an element is referred to as being "connected" or "coupled" to another element, it can be directly connected or coupled to the another element or be indirectly connected or coupled to the another element with one or more intervening elements interposed therebetween. In addition, when an element is referred to as "including" a component, this indicates that the element may further include another component instead of excluding another component unless there is different disclosure.

FIG. 1 illustrates an embodiment of a display device 1000 which may include a display panel 100 having a plurality of pixels PX and a panel driver for driving the display panel 100. The panel driver may drive the display panel 100 in a simultaneous emission manner. Each frame of the simultaneous emission manner may include a non-emission period (during which the pixels PX do not emit light) and an emission period (during which the pixels PX simultaneously emit light).

The display panel 100 may include the plurality of pixel PX to display an image. For example, the display panel 100 may include n*m pixels PX at locations corresponding to crossing points of the scan lines SL1 through SLn and the data lines DL1 through DLm, where n and m are integers greater than 1. The pixel PX may be connected to first and third power sources (ELVDD and VINT), one or both of which have voltage levels that change in each frame and which may be driven in the simultaneous emission manner.

In one example embodiment, the panel driver may include a scan driver 200, a data driver 300, a power supply 400, and a timing controller 500. The scan driver 200 may provide a scan signal to the pixels PX, via the scan lines SL1 through SLn, based on a first control signal CTL1.

The data driver 300 may convert digital image data to analog-type data signals. The data signals are supplied to the pixels PX, via the data lines DL1 through DLm, based on a second control signal CTL2.

The power supply 400 may provide the first power source ELVDD, the second power source ELVSS, and the third power source VINT to the pixels PX based on a third control signal CNT3. One or more of the first power source ELVDD, the second power source ELVSS, and the third power source VINT have voltage levels that change in each frame. For example, the power supply 400 may provide a DC-DC converter with switches. The DC-DC converter generates output voltages having various voltage levels from an input voltage (e.g., a battery voltage). The switches select output voltages based on the third control signal CNT3 to set the voltage levels of the first, second, and/or third power sources ELVDD, ELVSS, and VINT.

The timing controller 500 may control the scan driver 200, the data driver 300, and the power supply 400. For example, the timing controller 500 may receive control signal CNT from an external device (e.g., a system board). The timing controller 500 may generate the first through third control signals CTL1 through CTL3 to control the scan driver 200, the data driver 300, and the power supply 400. The first control signal CTL1 for controlling the scan driver 200 may include a scan start signal, a scan clock signal, etc. The second control signal CTL2 for controlling the data driver 300 may include a horizontal start signal, a load signal, image data, etc. The third control signal CTL3 for controlling the power supply 400 may include a switch control signal for controlling voltage levels of the first power source ELVDD, the second power source ELVSS, and/or the third power source VINT, etc. The timing controller 500 may generate digital image data to meet the operating conditions of the display panel 100 and based on the input image data. The generated image data is then provided to the data driver 300.

The display device 1000 may compensate the threshold voltage of the driving transistor and drive the pixels in the simultaneous emission manner to improve the display quality. In one embodiment, a head-mounted display system may be mounted on the head of a user, may enlarge an image (e.g., an image displayed on the display panel) using lens, and may provide the image direct to eyes of the user. In the head-mounted display system, when the display panel is driven in a progressive emission manner in which the pixels progressively emit light, motion blur may be recognized by the user. To solve this problem, the display device 1000 may drive the pixels (having relatively simple structures) in a simultaneous emission manner. Thus, a high-resolution display device may be realized and display quality may be improved.

Figure 2:
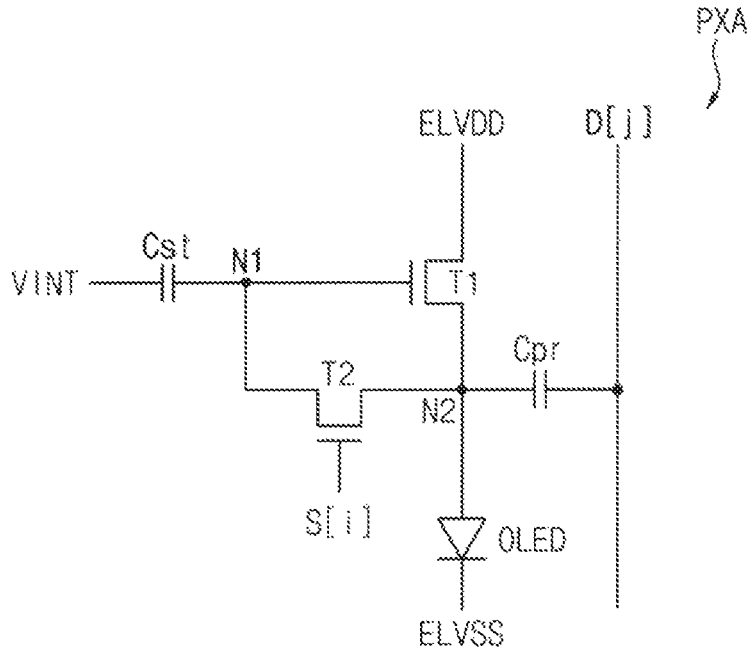
FIG. 2 illustrates an embodiment of a pixel.

FIG. 2 illustrates an embodiment of a pixel PXA, which may be representative of the pixels in the display device 1000 in FIG. 1. Referring to FIG. 2, the pixel PXA may include a first transistor T1, a second transistor T2, a first capacitor Cst, a second capacitor Cpr, and an organic light emitting diode (OLED). The pixel PXA may be located at the (i)th pixel row and the (j)th pixel column, where i is between 1 and n and j is between 1 and m. In one example embodiment, the first transistor T1 and the second transistor T2 may be n-channel Metal-Oxide-Semiconductor (nMOS) transistors.

The first transistor T1 may be a driving transistor. In one example embodiment, the first transistor T1 may include a gate electrode connected to the first node N1, a first electrode connected to a first power source ELVDD, and a second electrode connected to the second node N2.

The second transistor T2 may connect the gate electrode of the first transistor T1 to the second electrode of the first transistor T1 based on the scan signal S[i]. Thus, the second transistor T2 may form a diode connection of the first transistor T1. In one example embodiment, the second transistor T2 may include a gate electrode to receive the (i)th scan signal S[i] from the (i)th scan line, a first electrode connected to the first node N1, and a second electrode connected to the second node N2.

The first transistor T1 and the second transistor T2 may be low temperature poly silicon (LTPS) thin film transistors (TFTs), oxide TFTs, or another type of transistor. In one embodiment, the first transistor T1 may be the LTPS TFT, and the second transistor T2 may be the oxide TFT.

The first capacitor Cst may be between a third power source VINT and a first node N1. The third power VINT may be the initialization power source for initializing the driving transistor and/or the OLED of the pixels. For example, the third power VINT may have voltage levels for initializing the first electrode of OLED, the gate electrode of the first transistor T1, etc., in the initialization period. Also, the third power VINT may have voltage levels for providing the driving current to the OLED in the emission period. In one example embodiment, the first capacitor Cst may include a first electrode connected to the third power source VINT and a second electrode connected to the first node N1.

The second capacitor Cpr may be between the (j)th data line and the second node N2. In one example embodiment, the second capacitor Cpr may include a first electrode to receive the data signal D[j] from the (j)th data line and a second electrode connected to the second node N2.

The OLED may emit light based on driving current flowing from the first transistor T1. In one example embodiment, the OLED may include a first electrode connected to the second node N2 and a second electrode connected to the second power source ELVSS. For example, the OLED may further include diode capacitor connected in parallel with the organic light emitting diode OLED. For example, the diode capacitor may be a parasitic capacitor.

Figure 3:
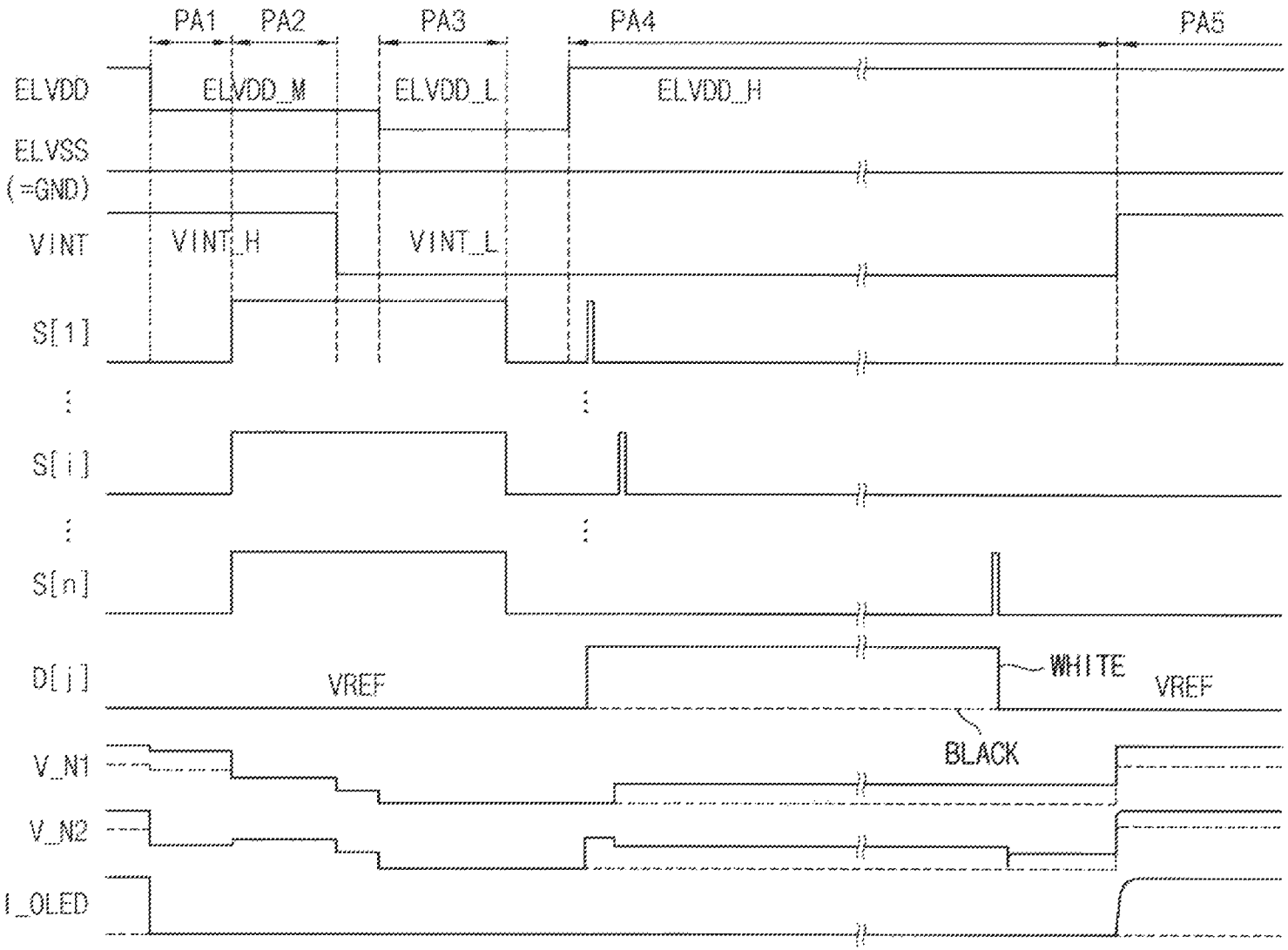
FIGS. 3 and 4 illustrate an embodiment of signals for driving pixels in a simultaneous emission manner.
Figure 4:
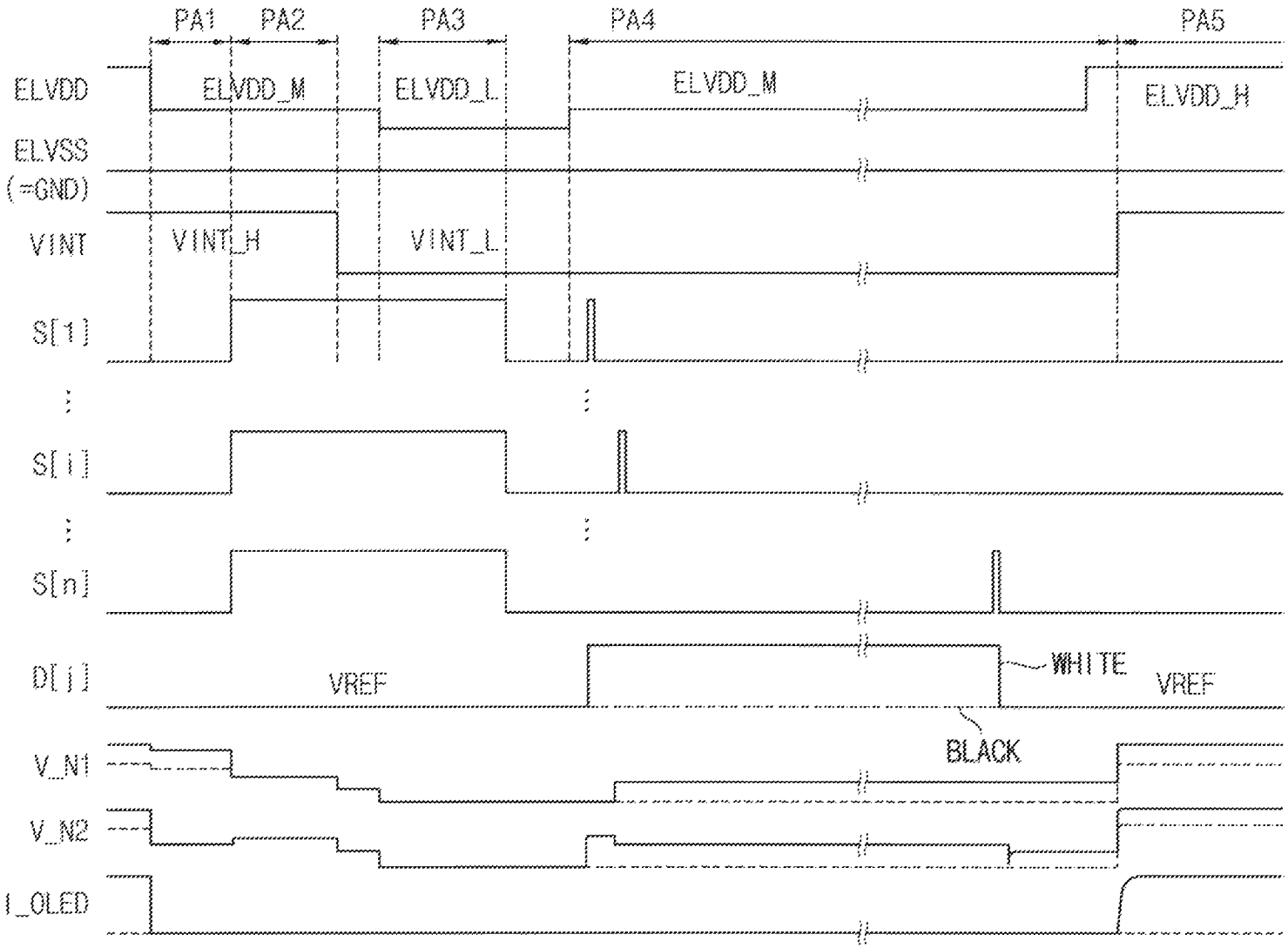

FIGS. 3 and 4 illustrate embodiments of signals for driving the pixel PXA in FIG. 2 in a simultaneous emission manner. Referring to FIGS. 2 to 4, the panel driver may drive the display panel in the simultaneous emission manner. Each frame for driving pixels in a simultaneous emission manner may include a non-emission period PA1 through PA4 (during which the pixels do not emit light) and an emission period PA5 (during which the pixels simultaneously emit light). The non-emission period may sequentially include a first initialization period PA1 during which the first electrode of the OLED is initialized and a second initialization period PA2 during which the gate electrode of the first transistor T1 is initialized, a threshold voltage compensation period PA3 during which a diode connection of the first transistor T1 is formed, and a data writing period PA4 during which the data signal is provided to the pixel.

The pixels may be connected to the first power source ELVDD and the third power source VINT, one or both of which have voltage levels that change in each frame (e.g., AC power sources). For example, the voltage level of the first power source ELVDD may correspond to one of a first voltage level ELVDD_L, a second voltage level ELVDD_M greater than the first voltage level ELVDD_L, or a third voltage level ELVDD_H greater than the second voltage level ELVDD_M. The voltage level of the third power source VINT may correspond to one of a fourth voltage level VINT_L or a fifth voltage level VINT_H greater than the fourth voltage level VINT_L. A voltage level of the second power source ELVSS may be maintained constantly. For example, the second power source ELVSS may have a ground voltage level GND. In addition, a reference voltage VREF may be applied to the data lines except in the data writing period PA4. The data signal voltages represent grayscales (e.g., voltages between a black color voltage BLACK and a white color voltage WHITE) are applied to the data lines in the data writing period PA4.

Referring to FIG. 3, during the first initialization period PA1, the first power source ELVDD may have the second voltage level ELVDD_M. The third power source VINT may have the fifth voltage level VINT_H which is greater than the second voltage level ELVDD_M. The scan signal S[i] may have an off-level. Accordingly, current may flow from the second node N2 to the first power source ELVDD via the first transistor T1. Then, a voltage V_N2 of the second node N2 may be set to the second voltage level ELVDD_M. Thus, a voltage of the first electrode of the OLED may be initialized.

During the second initialization period PA2, the first power source ELVDD may have the second voltage level ELVDD_M. The third power source VINT may have the fifth voltage level VINT_H. The scan signal S[i] may have an on-level. When the gate electrode and the second electrode of the first transistor T1 are connected to each other by the second transistor T2, the first transistor T1 is placed in a diode-connected state. Therefore, a voltage V_N1 of the first node and a voltage V_N2 of the second node may correspond to a voltage which corresponds to a sum of the threshold voltage Vth of the first transistor T1 and the second voltage level ELVDD_M (e.g., ELVDD_M+Vth). Thus, the voltage of the first electrode of the OLED and the voltage of the gate electrode of the first transistor T1 may be initialized.

During the threshold voltage compensation period PA3, the first power source ELVDD may have the first voltage level ELVDD_L. The third power source VINT may have the fourth voltage level VINT_L. The scan signal S[i] may have an on-level. Accordingly, the first transistor T1 may be placed in a diode-connected state. The voltage V_N1 of the first node and the voltage V_N2 of the second node may correspond to a voltage that corresponds to the sum of the threshold voltage Vth of the first transistor T1 and the first voltage level ELVDD_L (e.g., ELVDD_L+Vth).

During the data writing period PA4, the first power source ELVDD may have the third voltage level ELVDD_H. The third power source VINT may have the fourth voltage level VINT_L. The panel driver may progressively provide the scan signals S[1] through S[n] having an on-level to the scan lines. Thus, data signals D[j] are programmed in the pixels.

At the start time point of the data writing period PA4 (e.g., at the first time point), quantities of electric charge of the first capacitor Cst, the second capacitor Cpr, and the capacitor of the OLED (e.g., diode capacitor) in the first pixel at the (i)th pixel row and the (j)th pixel column may be calculated based on Equations 1 to Equation 3.

$$Qst1=(ELVDD_L+Vth-VINT_L)*Cst \quad (1)$$

$$Qpr1=(ELVDD_L+Vth-Vref)*Cpr \quad (2)$$

$$Qoled1=(ELVDD_L+Vth-ELVSS)*Coled \quad (3)$$

where Qst1, Qpr1, Qoled1 respectively indicate the quantity of electric charge of the first capacitor, the second capacitor, and the capacitor of the OLED at the first time point. ELVDD_L indicates the first voltage level of the first power source, Vth indicates the threshold voltage of the first transistor, VINT_L indicates the fourth voltage level of the third power source, Vref indicates the reference voltage, ELVSS indicates the voltage level of the second power source, Cst, Cpr, Coled indicate respectively capacitance of the first capacitor, the second capacitor, and the capacitor of the OLED.

Immediately after the scan signal S[i] having an on-level is provided to the (i)th pixel row in the data writing period PA4 (e.g., at the second time point), quantities of electric charge of the first capacitor Cst, the second capacitor Cpr, and the capacitor of the OLED in the first pixel at the (i)th pixel row and the (j)th pixel column may be calculated based on Equation 4 to Equation 6.

$$Qst2=(V\text{gate}-VINT_L)*Cst \quad (4)$$

$$Qpr2=(V\text{gate}-V\text{data}(i,j))*Cpr \quad (5)$$

$$Qoled2=(V\text{gate}-ELVSS)*Coled \quad (6)$$

where Qst2, Qpr2, Qoled2 respectively indicate the quantity of electric charge of the first capacitor, the second capacitor, and the capacitor of the OLED at the second time point. Vgate indicates a voltage of the gate electrode of the first transistor, VINT_L indicates the fourth voltage level of the third power source, Vdata (i,j) indicates a voltage of the data signal, ELVSS indicates the voltage level of the second power source, Cst, Cpr, Coled indicate respectively capacitance of the first capacitor, the second capacitor, and the capacitor of the OLED.

Since there is no current path between the gate electrode and the source electrode of the driving transistor in the pixel during a period between the first time point and the second time point, a total quantity of electric charge at the first time point may equal to a total quantity of electric charge at the second time point (e.g., Qst1+Qpr1+Qoled1=Qst2+Qpr2+Qoled2). A voltage (Vgate) of gate electrode of the driving transistor of the first pixel in the data writing period PA4 may be calculated based on Equation 7 derived based on Equation 1 to Equation 6.

$$Vgate = \text{ELVDD_L} + Vth + \frac{(Vdata(i,\ j) - Vref) \times Cpr}{(Cst + Cpr + Coled)} \quad (7)$$

Therefore, the voltage of the gate electrode of the driving transistor may be set independently and regardless of the data signal voltage at another timing.

During the emission period PA5, the first power source ELVDD may have the third voltage level ELVDD_H. The third power source VINT may have the fifth voltage level VINT_H. The scan signal S[i] has an off-level. Thus, at the start point of the emission period PA5, the voltage level of the third power source VINT may increase from the fourth voltage level VINT_L to the fifth voltage level VINT_H. The voltage V_N1 of the first node (e.g., the voltage of the gate electrode of the driving transistor) may increase corresponding to change amount (e.g., VINT_H−VINT_L) of the voltage level of the third power source VINT. Accordingly, the driving current I_OLED may be generated according to the voltage difference between the gate electrode and the source electrode (e.g., the second electrode) of the first transistor T1. The driving current I_OLED may flow through the OLED from the first transistor T1, and then all of the pixels may simultaneously emit light.

The pixel may be driven by methods different from the method in FIG. 3. For example, as shown in FIG. 4, the first power source ELVDD may have the second voltage level ELVDD_M during the data writing period PA4. The third power source VINT may have the fourth voltage level VINT_L. The panel driver may progressively provide the scan signals S[1] through S[n] having an on-level to the scan lines, such that data signals are programmed in the pixels.

Thus, unlike the method of FIG. 3, the driving method in FIG. 4 sets the voltage level of the first power source ELVDD to the second voltage level ELVDD_M during the data writing period PA4. This may prevent leakage current from the first power source ELVDD to the second node N2, via first transistor T1, during the data writing period PA4. For example, the voltage of the first electrode of the first transistor T1 may be set to a voltage level (e.g., the second voltage level ELVDD_M) between the first voltage level ELVDD_L and the third voltage level ELVDD_H to remove the leakage current path. Accordingly, the change of the data signal programmed in the pixel resulting from leakage current may be prevented. Also, display quality degradation (e.g., stain, defect, etc) occurring as a result of luminance deviation between pixels may be prevented.

Figure 5:
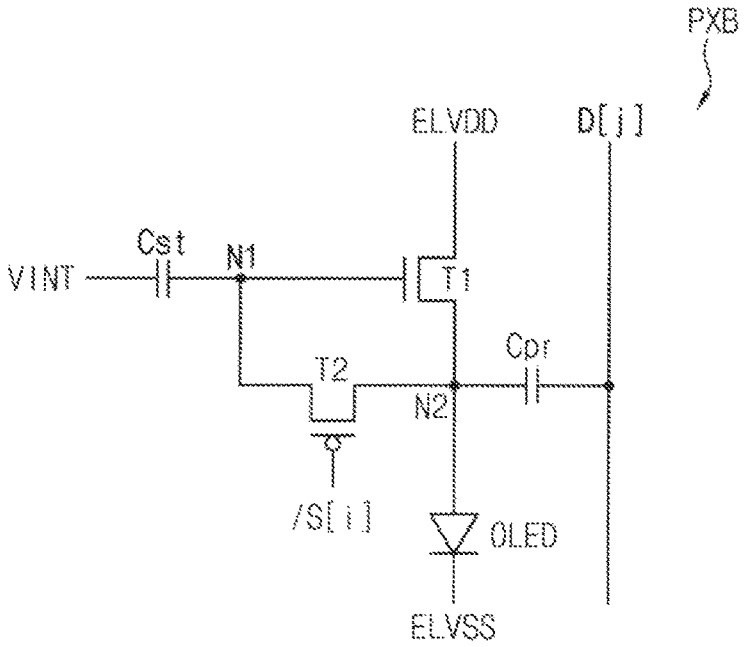
FIGS. 5 to 7 illustrate embodiments of pixel circuits.
Figure 6:
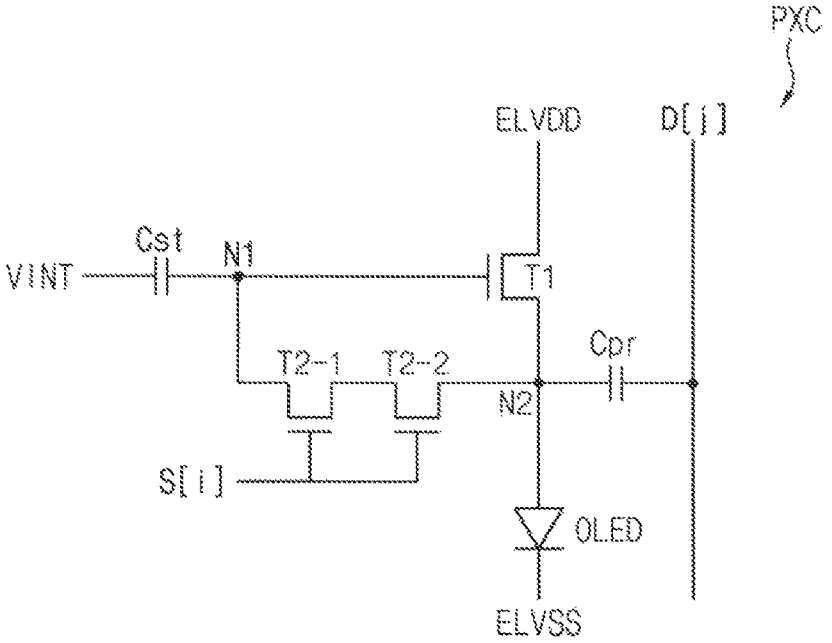
Figure 7:
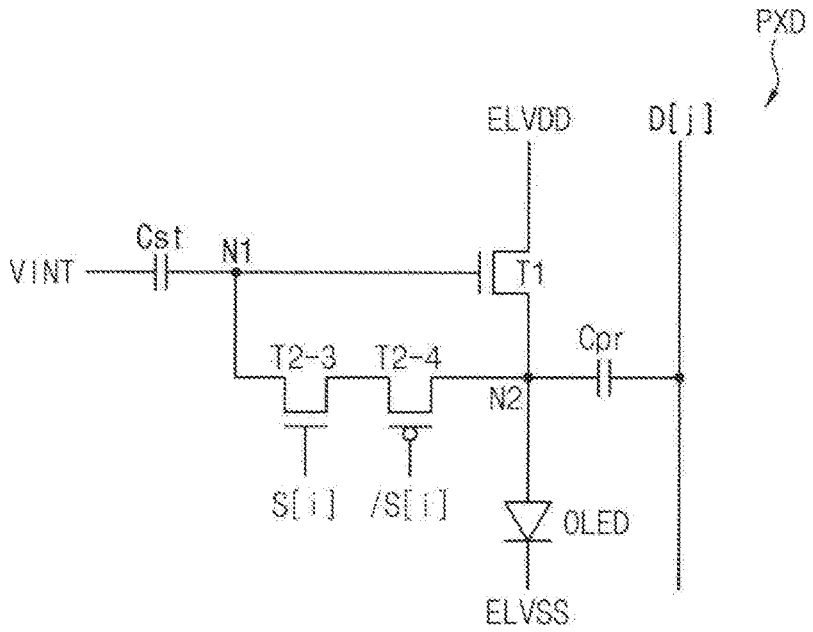

FIGS. 5 to 7 illustrate additional embodiments of pixels PXB, PXC, or PXD that may be representative of the pixels in the display device in FIG. 1. Referring to FIGS. 5 through 7, the pixels PXB, PXC, or PXD may include a first transistor T1, a second transistor T2, a first capacitor Cst, a second capacitor Cpr, and an organic light emitting diode (OLED). The pixel PXB, PXC, or PXD may be substantially the same as pixel PXA in FIG. 2, except that the second transistor is a pMOS transistor or dual transistor.

The first transistor T1 may be a driving transistor. In one example embodiment, the first transistor T1 may include a gate electrode connected to the first node N1, a first electrode connected to a first power source ELVDD, and a second electrode connected to the second node N2. The first transistor T1 may be nMOS transistor.

The second transistor T2 may connect the gate electrode of the first transistor T1 to the second electrode of the first transistor T1 in response to the scan signal.

In one example embodiment, as shown in FIG. 5, the first transistor T1 and the second transistor T2 in the pixel PXB may be different types of MOS transistors. For example, the first transistor T1 may be nMOS transistor and the second transistor T2 may be pMOS transistor. The second transistor T2 of the pixel PXB may connect the first node N1 to the second node N2 based on an inverted scan signal/S[i].

In another example embodiment, as shown in FIGS. 6 and 7, the second transistor T2 in the pixels PXC or PXD may be implemented as a dual transistor (e.g., two transistors connected to each other in series) to reduce leakage current. For example, like FIG. 6, the pixel PXC may include the (2-1)st transistor T2-1 and the (2-2)nd transistor T2-2 connected to each other in series, and that connect the gate electrode of the first transistor T1 to the second electrode of the first transistor T1 based on the scan signal S[i]. In addition, like FIG. 7, the pixel PXD may include the (2-3)rd transistor T2-3 and the (2-4)th transistor T2-4 connected to each other in series, and that connect the gate electrode of the first transistor T1 to the second electrode of the first transistor T1 based on the scan signal S[i] and the inverted scan signal/S[i].

The first capacitor Cst may include a first electrode connected to the third power source VINT and a second electrode connected to the first node N1.

The second capacitor Cpr may include a first electrode to receive the data signal D[j] from the (j)th data line and a second electrode connected to the second node N2.

The OLED may include a first electrode connected to the second node N2 and a second electrode connected to the second power source ELVSS.

Figure 8:
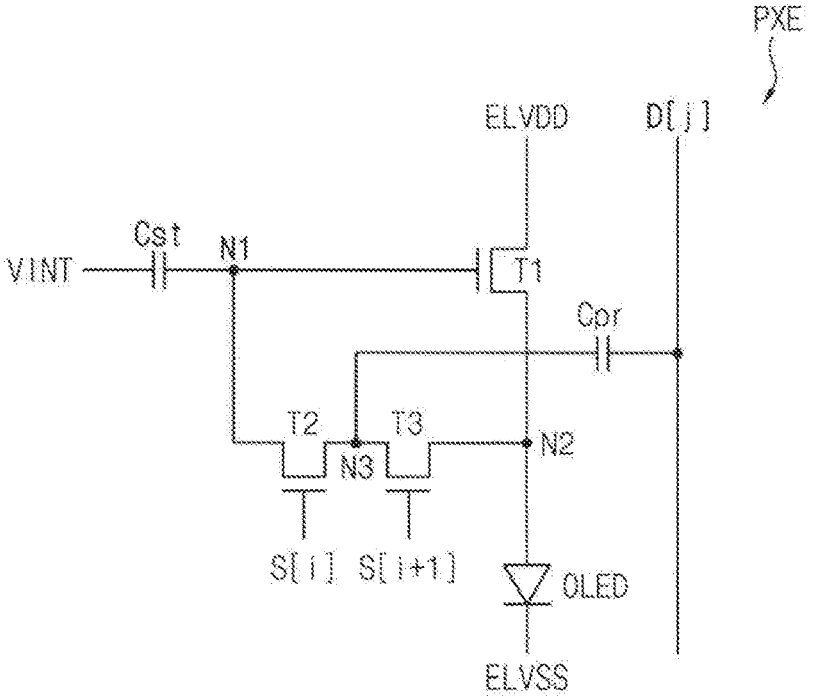
FIG. 8 illustrates another embodiment of a pixel circuit.

FIG. 8 illustrates another embodiment of a pixel PXE, which may be representative of the pixels in the display device in FIG. 1. Referring to FIG. 8, the pixel PXE may include a first transistor T1, a second transistor T2, a third transistor T3, a first capacitor Cst, a second capacitor Cpr, and an OLED. The pixel PXE may be located at the (i)th pixel row and the (j)th pixel column.

The first transistor T1 may be a driving transistor. In one example embodiment, the first transistor T1 may include a gate electrode connected to the first node N1, a first electrode connected to a first power source ELVDD, and a second electrode connected to the second node N2.

The second transistor T2 may connect the first node N1 to the third node N3 based on the (i)th scan signal S[i]. In one example embodiment, the second transistor T2 may include a gate electrode receiving the (i)th scan signal S[i] from the (i)th scan line, a first electrode connected to the first node N1, and a second electrode connected to the third node N3.

The third transistor T3 may connect the third node N3 to the second node N2 based on the (i+1)th scan signal S[i+1]. In one example embodiment, the third transistor T3 may include a gate electrode receiving the (i+1)th scan signal S[i+1] from the (i+1)th scan line, a first electrode connected to the third node N3, and a second electrode connected to the second node N2.

The first capacitor Cst may be between a third power source VINT and a first node N1. In one example embodiment, the first capacitor Cst may include a first electrode connected to the third power source VINT and a second electrode connected to the first node N1.

The second capacitor Cpr may be between the (j)th data line and the third node N3. In one example embodiment, the second capacitor Cpr may include a first electrode to receive the data signal D[j] from the (j)th data line and a second electrode connected to the third node N3.

The OLED may emit light based on driving current flowing from the first transistor T1. In one example embodiment, the OLED may include a first electrode connected to the second node N2 and a second electrode connected to the second power source ELVSS.

Thus, the pixel PXE in FIG. 8 may further include the third transistor T3 between the second electrode of the second transistor T2 and the first electrode of the OLED in comparison with the pixel PXA in FIG. 2. Accordingly, in the pixel PXE, the second node N2 and the third node N3 may be separated from each other by the third transistor T3. Although leakage current flowing from the first power source ELVDD to the second node T2, via the first transistor T1, occurs while the data signal D[j] is programmed, the data signal D[j] programmed in the gate electrode of the first transistor T1 (e.g., the first node N1) is not affected by leakage current. Thus, display quality may be improved.

In one example embodiment, the second transistor T2 may be the LTPS TFT and the third transistor T3 may be the oxide TFT. The LTPS TFT may have relatively high electron mobility and stability, while the magnitude of leakage current may be relatively large in comparison with the oxide TFT. Therefore, the third transistor T3 may be an oxide TFT to prevent leakage current flowing through the third transistor T3.

FIGS. 9A to 9H illustrate another embodiment of a pixel PXE', which may be representative of the pixels in the display device of FIG. 1. FIGS. 10A and 10B illustrate an example in which pixel PXE' in FIGS. 9A to 9H is driven in a simultaneous emission manner.

Referring to FIGS. 9A to 9H and 10A to 10B, the pixel PXE' may include a first transistor T1, a second transistor T2, a third transistor T3, a first capacitor Cst, a second capacitor Cpr, and an OLED. The pixel PXE' may be at the (i)th pixel row and the (j)th pixel column. The pixel PXE' may be substantially the same as the pixel PXE in FIG. 8, except that the gate electrode of the third transistor T3 receives the common control signal GC.

The first transistor T1 may include a gate electrode connected to the first node N1, a first electrode connected to a first power source ELVDD, and a second electrode connected to the second node N2. The second transistor T2 may include a gate electrode to receive the (i)th scan signal S[i] from the (i)th scan line, a first electrode connected to the first node N1, and a second electrode connected to the third node N3. The third transistor T3 may include a gate electrode to receive the common control signal GC, a first electrode connected to the third node N3, and a second electrode connected to the second node N2.

Referring to FIG. 10A, the same common control signal GC may be provided to all pixels in the display panel. The same common control signal GC may have an on-level during the second initialization period PA2 and the threshold voltage compensation period PA3. Also, the same common control signal GC may have an off-level during the first initialization period PA1 and the data writing period PA4. Since the pixel PXE' in FIGS. 9A to 9H may be driven in substantially the same manner as the method of driving the pixel in FIG. 3.

The first capacitor Cst may be between a third power source VINT and a first node N1. The second capacitor Cpr may be between the (j)th data line and the third node N3. The OLED may emit light based on driving current flowing from the first transistor T1.

In one example embodiment, the second transistor T2 may be an LTPS TFT and the third transistor T3 may be an oxide TFT. The LTPS TFT may have relatively high electron mobility and stability, while the magnitude of leakage current may be relatively large in comparison with the oxide TFT. Therefore, the third transistor T3 may be an oxide TFT to prevent leakage current flowing through the third transistor T3.

Figure 9A:
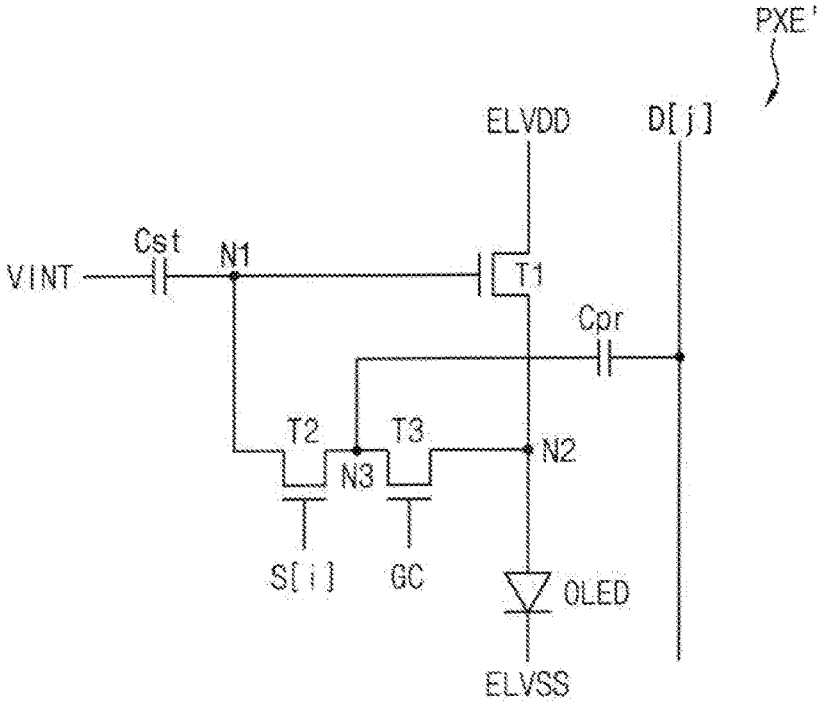
FIGS. 9A to 9H illustrate another embodiment of a pixel circuits.
Figure 9B:
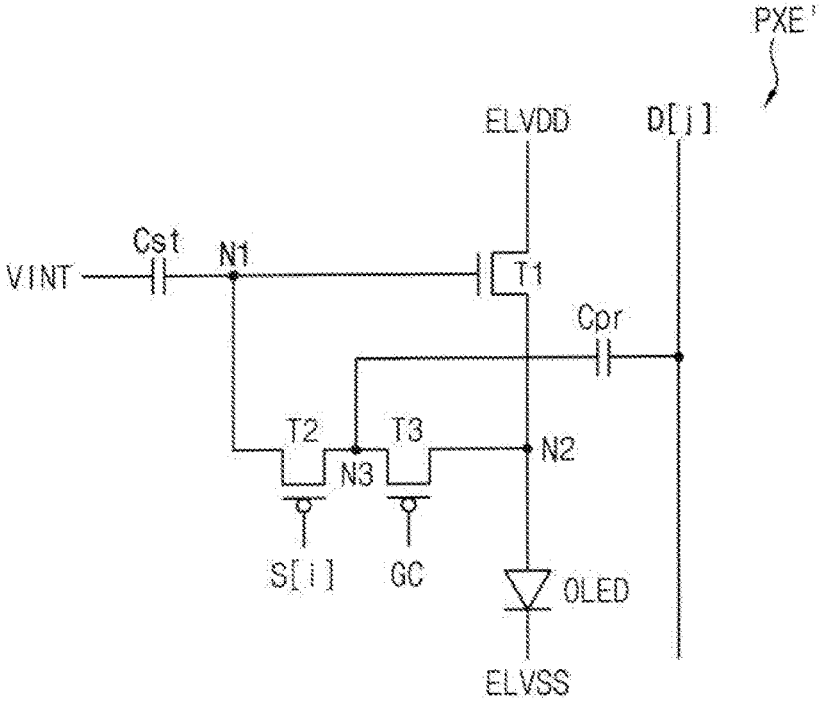
Figure 9C:
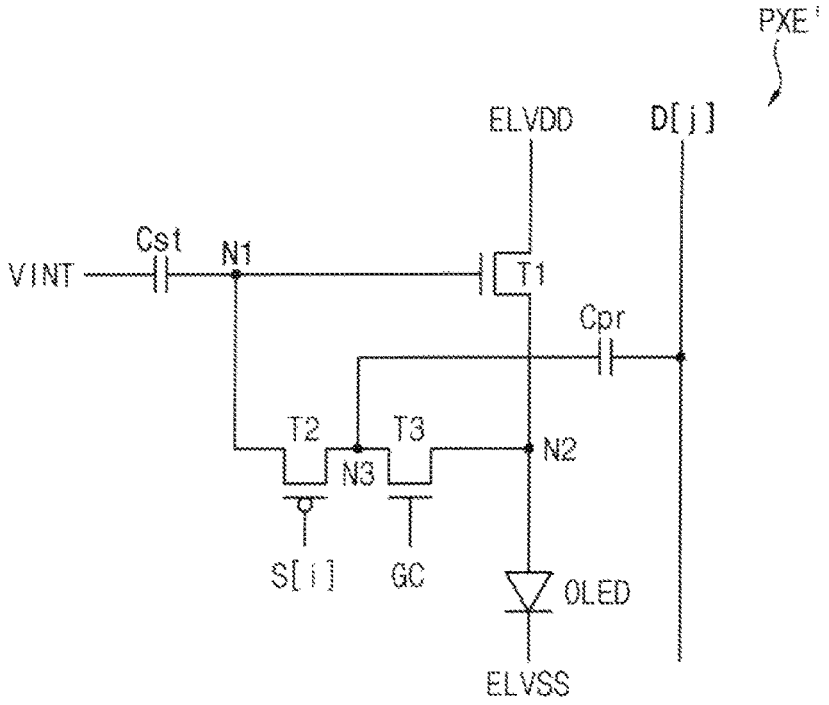
Figure 9D:
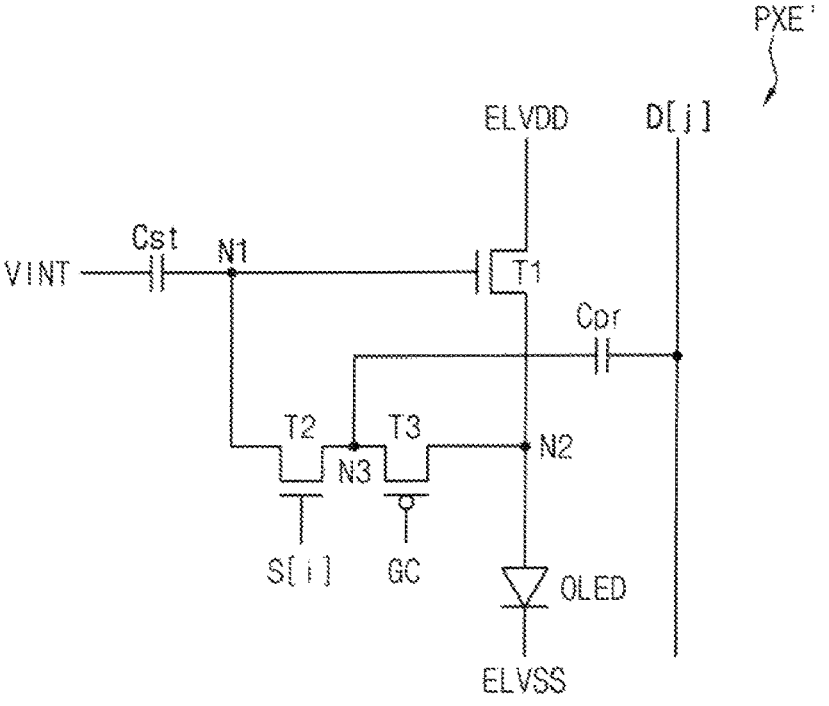
Figure 9E:
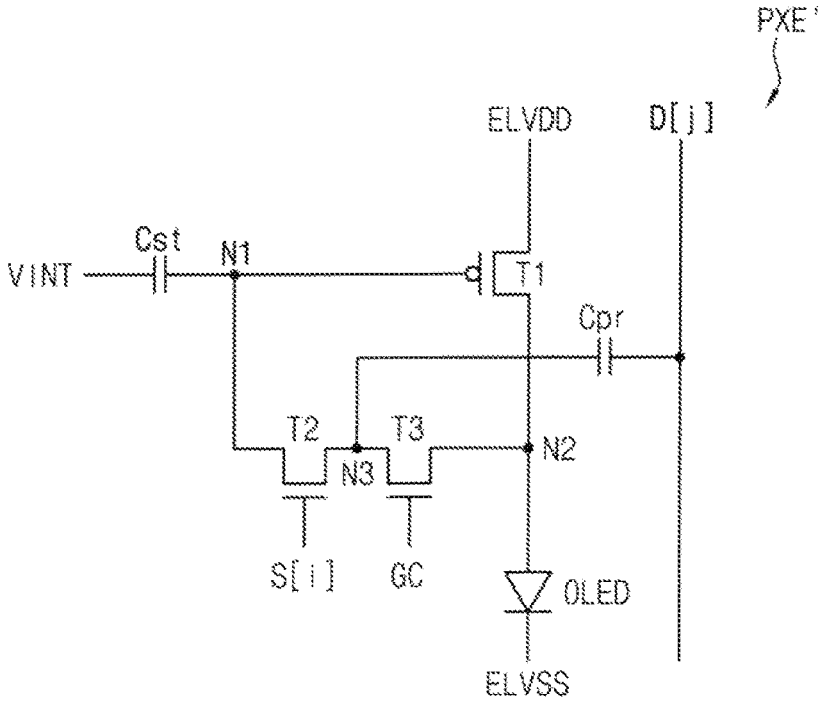
Figure 9F:
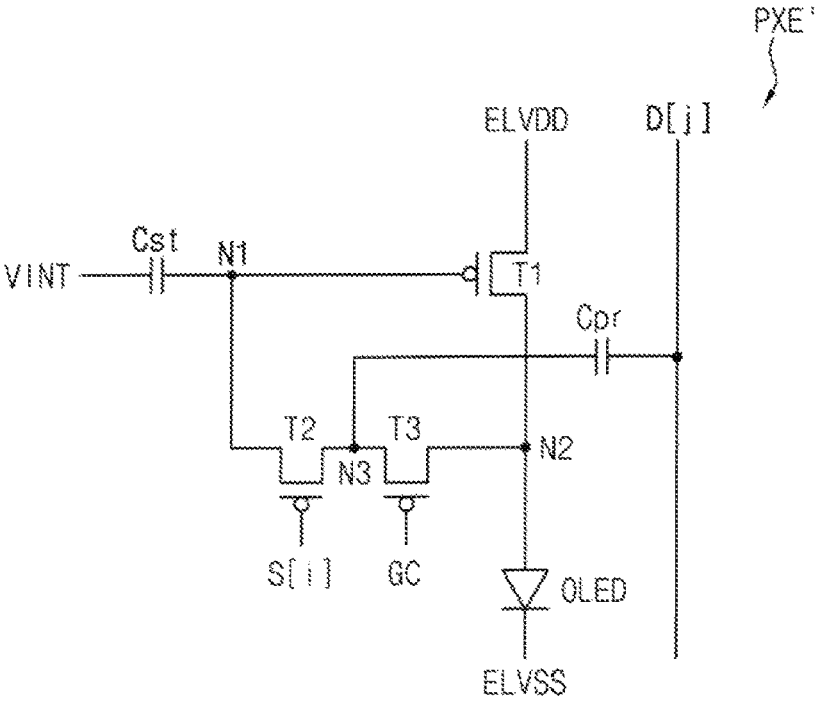
Figure 9G:
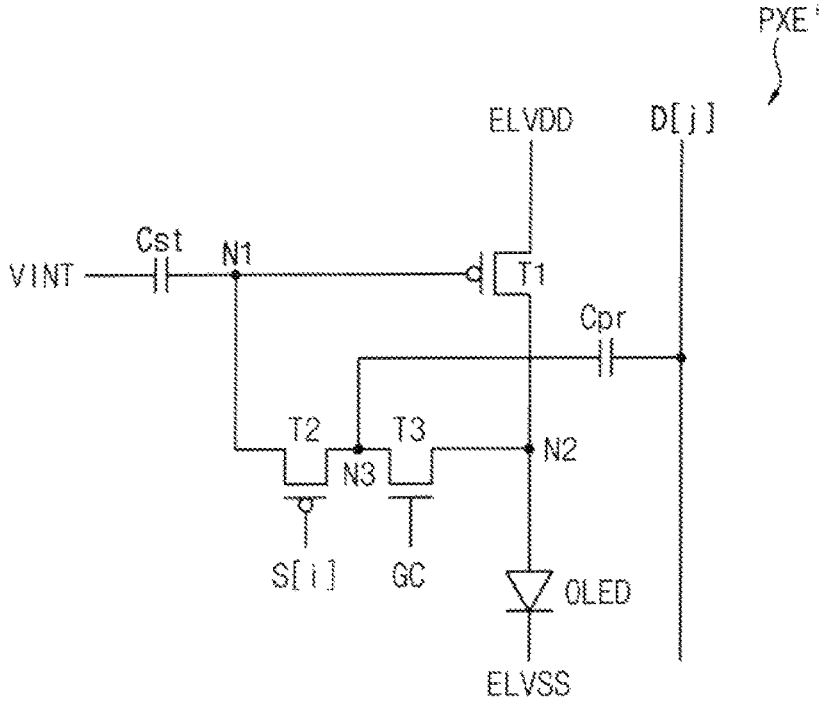
Figure 9H:
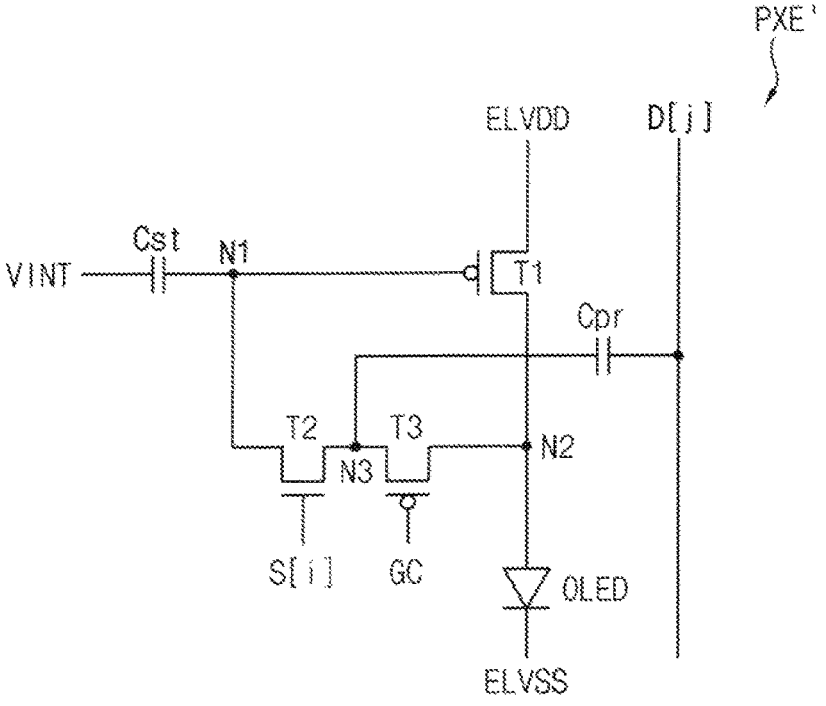
Figure 10A:
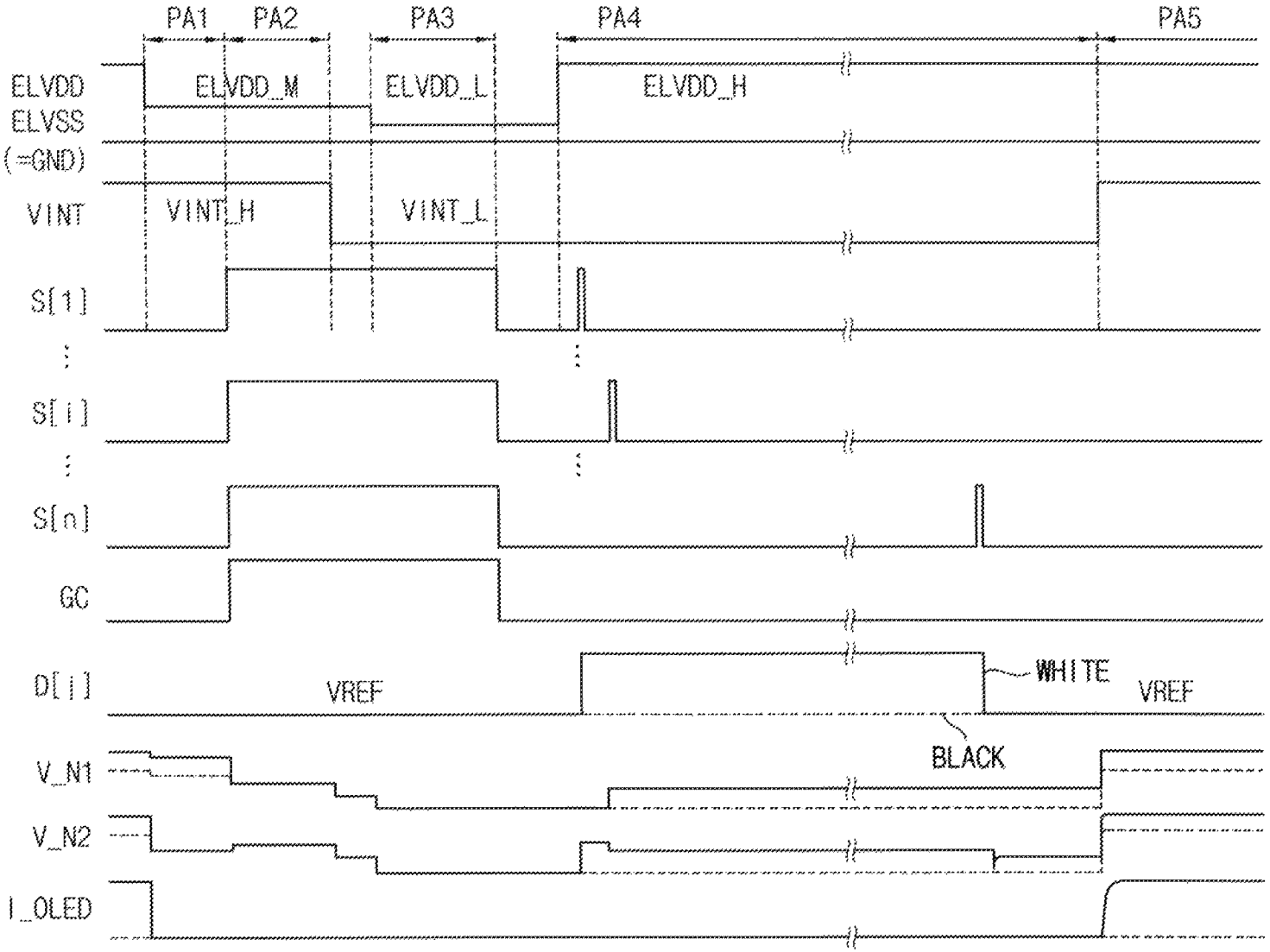
FIGS. 10A and 10B illustrate an embodiment of signals for driving pixels in a simultaneous emission manner.
Figure 10B:
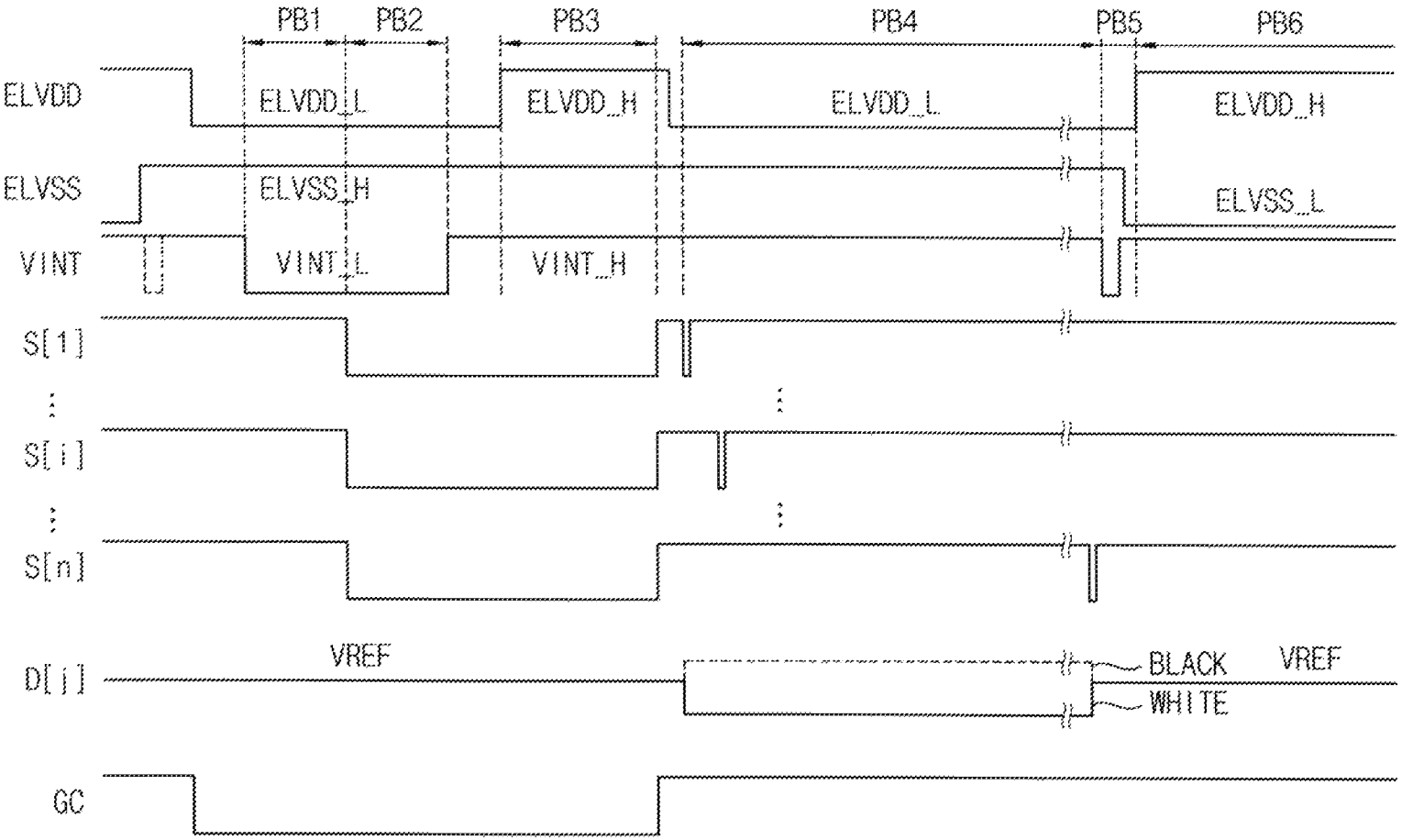

As illustrated in FIGS. 9A to 9H, the second and third transistors T2 and T3 may be nMOS transistors. In one embodiment, the second transistor T2 and/or the third transistor T3 may be pMOS transistors. For example, as illustrated in FIG. 9B, the second and third transistors T2 and T3 may be pMOS transistors. For example, as illustrated in FIG. 9C, the second transistor T2 may be a pMOS transistor, and the third transistor T3 may be an nMOS transistor. For example, as illustrated in FIG. 9D, the second transistor T2 may be an nMOS transistor, and the third transistor T3 may be a pMOS transistor. In addition, as illustrated in FIG. 9A, the first transistor T1 may be an nMOS transistor. In one embodiment, as illustrated in FIGS. 9E to 9H, the first transistor T1 may be a pMOS transistor. In some embodiments, the scan signals S[1] through S[n] and/or the common control signal GC may be inverted.

The second transistor T2 is an LTPS TFT and the third transistor T3 is an oxide TFT. The second transistor T2 and/or the third transistor T3 may be formed by various TFT processes and may have active layer including various materials. Although it is described above that the pixel PXE' is driven according to a waveform shown in FIG. 10A, the present inventive concept is not limited thereto. For example, the pixel PXE' may be driven according to a waveform shown in FIG. 10B, which is similar to waveforms shown in FIGS. 12 and 13.

Figure 11:
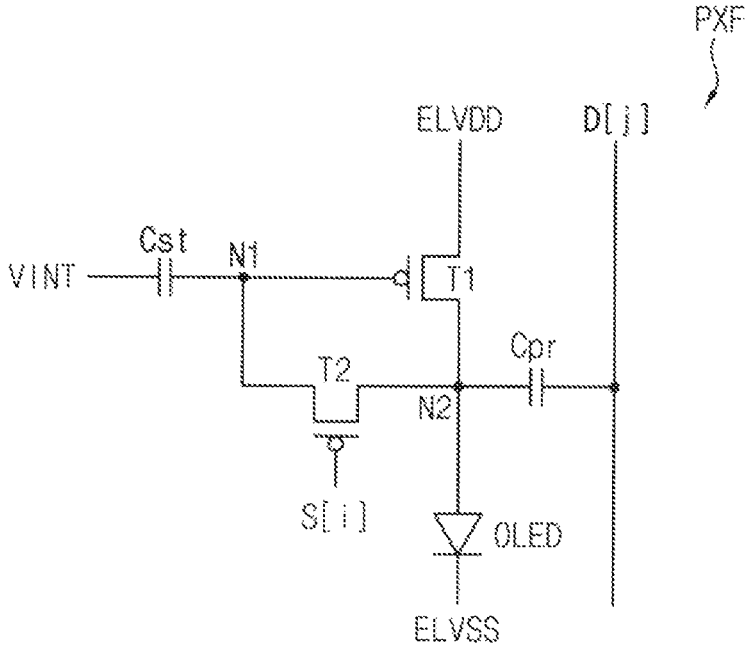
FIG. 11 illustrates another embodiment of a pixel.

FIG. 11 illustrates another embodiment of a pixel PXF in the display device of FIG. 1. Referring to FIG. 11, the pixel PXF may include a first transistor T1, a second transistor T2, a first capacitor Cst, a second capacitor Cpr, and an OLED. The pixel PXF may be at the (i)th pixel row and the (j)th pixel column. In one example embodiment, the first transistor T1 and the second transistor T2 may be p-channel Metal-Oxide-Semiconductor (pMOS) transistors.

The first transistor T1 may be a driving transistor. In one example embodiment, the first transistor T1 may include a gate electrode connected to the first node N1, a first electrode connected to a first power source ELVDD, and a second electrode connected to the second node N2.

The second transistor T2 may connect the gate electrode of the first transistor T1 to the second electrode of the first transistor T1 based on the scan signal S[i]. In one example embodiment, the second transistor T2 may include a gate electrode connected to the (i)th scan line, a first electrode connected to the first node N1, and a second electrode connected to the second node N2.

The first capacitor Cst may be between a third power source VINT and a first node N1. In one example embodiment, the first capacitor Cst may include a first electrode connected to the third power source VINT and a second electrode connected to the first node N1.

The second capacitor Cpr may be between the (j)th data line and the second node N2. In one example embodiment, the second capacitor Cpr may include a first electrode to receive the data signal D[j] from the (j)th data line and a second electrode connected to the second node N2.

The OLED may emit light based on driving current flowing from the first transistor T1. In one example embodiment, the OLED may include a first electrode connected to the second node N2 and a second electrode connected to the second power source ELVSS.

Figure 12:
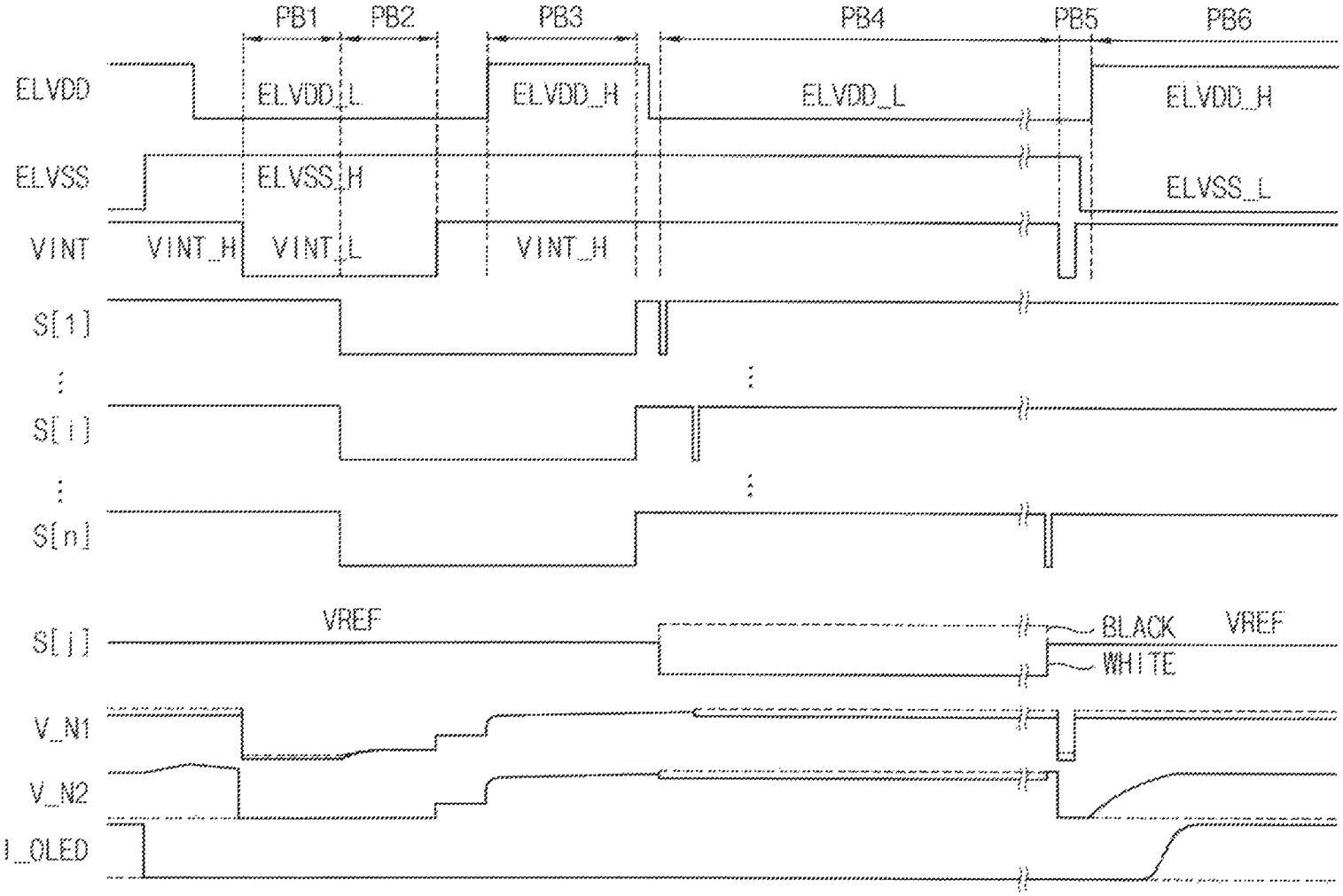
FIGS. 12 and 13 illustrate embodiments for driving pixels in a simultaneous emission manner.
Figure 13:
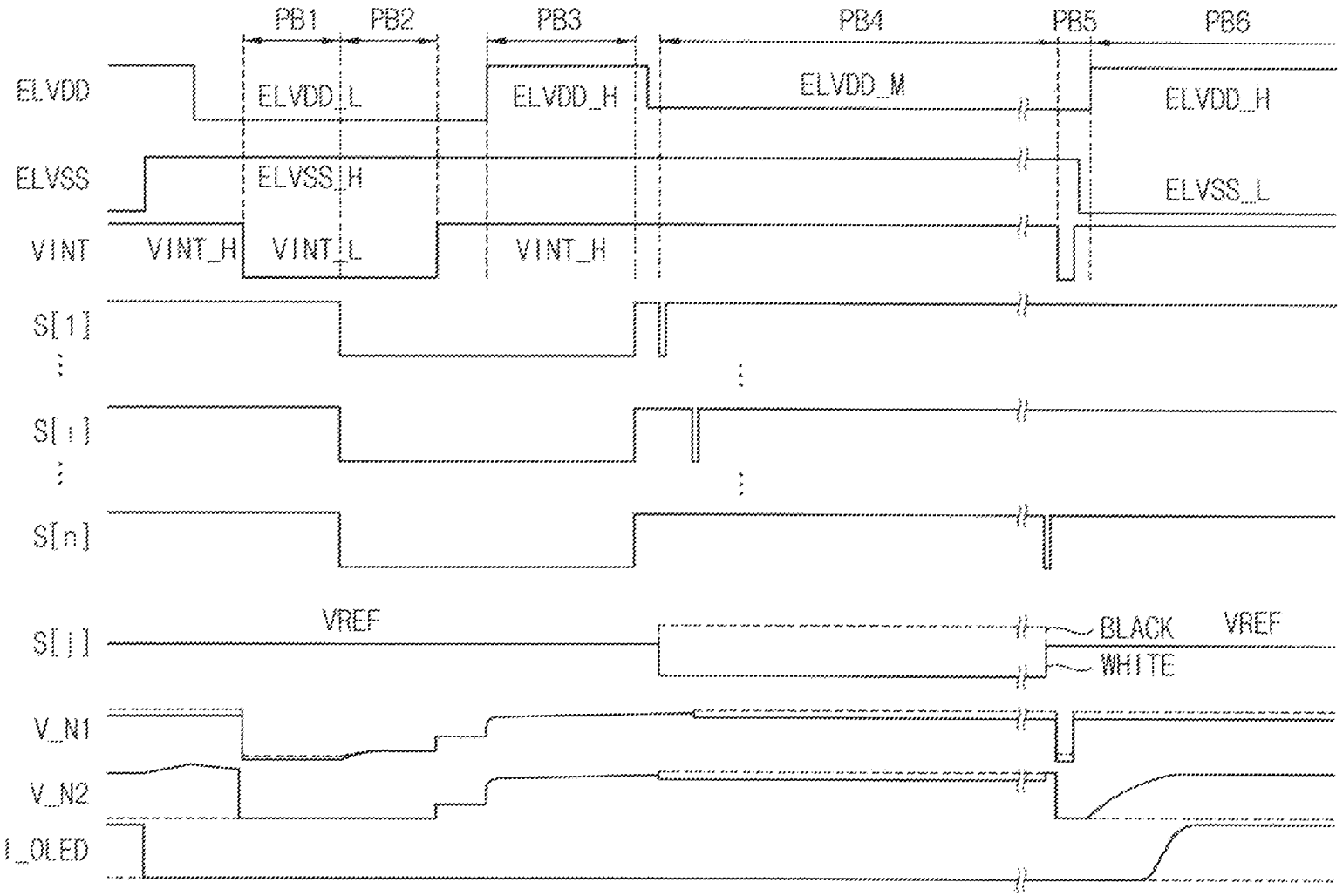

FIGS. 12 and 13 illustrate embodiments of signals for driving the pixel PXF in FIG. 11 in a simultaneous emission manner. Referring to FIGS. 12 and 13, the panel driver may drive the display panel in a simultaneous emission manner. Each frame implemented in a simultaneous emission manner may include a non-emission period PB1 through PB5 (during which pixels do not emit light) and an emission period PB6 (during which the pixels simultaneously emit light). The non-emission period may sequentially include a first initialization period PB1 during which the first electrode of the OLED is initialized and a second initialization period PB2 during which the gate electrode of the first transistor T1 is initialized, a threshold voltage compensation period PB3 during which a diode connection of the first transistor T1 is formed, a data writing period PB4 during which the data signal is provided to the pixel, and a third initialization period PB5 during which the first electrode of the OLED is initialized.

The pixels may be connected to the first power source ELVDD, the third power source VINT, and the second power source ELVSS, one or more of which have voltage levels that change in each frame (e.g., AC power sources). For example, the voltage level of the first power source ELVDD may correspond to one of a first voltage level ELVDD_L, a second voltage level ELVDD_M greater than the first voltage level ELVDD_L, or a third voltage level ELVDD_H greater than the second voltage level ELVDD_M.

Also, the voltage level of the third power source VINT may correspond to one of a fourth voltage level VINT_L or a fifth voltage level VINT_H greater than the fourth voltage level VINT_L. The voltage level of the second power source ELVSS may correspond to one of a sixth voltage level ELVSS_L or a seventh voltage level ELVSS_H greater than the sixth voltage level ELVSS_L. In addition, a reference voltage VREF may be applied to the data line, except in the data writing period PB4. Then, the data signal voltages (e.g., voltages between a black color voltage BLACK and a white color voltage WHITE) which represent grayscales may be applied to the data line in the data writing period PB4.

Referring to FIG. 12, during the first initialization period PB1, the first power source ELVDD may have the first voltage level ELVDD_L. The third power source VINT may have the fourth voltage level VINT_L. The second power source ELVSS may have the seventh voltage level ELVSS_H. The scan signals S[1] through S[n] may have an off-level. Accordingly, current may flow from the second node N2 to the first power source ELVDD via the first transistor T1, and then a voltage V_N2 of the second node N2 may be set to the first voltage level ELVDD_L. Thus, a voltage of the first electrode of the OLED may be initialized.

During the second initialization period PB2, the first power source ELVDD may have the first voltage level ELVDD_L. The third power source VINT may have the fourth voltage level VINT_L. The second power source ELVSS may have the seventh voltage level ELVSS_H. The scan signals S[1] through S[n] may have an on-level. Accordingly, charge sharing between the first node N1 and the second node N2 may occur when the second transistor T2 is turned-on. Then, the voltage of the first electrode of the OLED and the voltage of the gate electrode of the first transistor T1 may be initialized.

During the threshold voltage compensation period PB3, the first power source ELVDD has the third voltage level ELVDD_H. The third power source VINT may have the fifth voltage level VINT_H. The second power source ELVSS may have the seventh voltage level ELVSS_H. The scan signals S[1] through S[n] may have an on-level. Accordingly, the first transistor T1 may be placed in a diode-connected state. The voltage V_N1 of the first node and the voltage V_N2 of the second node may correspond to a voltage obtained by applying the threshold voltage Vth of the first transistor T1 to the third voltage level ELVDD_H.

During the data writing period PB4, the first power source ELVDD may have the first voltage level ELVDD_L. The third power source VINT may have the fifth voltage level VINT_H. The second power source ELVSS may have the seventh voltage level ELVSS_H. The panel driver may progressively provide the first to (n)th scan signals S[1] through S[n] having an on-level to the first through (n)th scan lines, such that the data signals are programmed in the pixels.

During the third initialization period PB5, the first power source ELVDD may have the first voltage level ELVDD_L. The voltage level of the third power source VINT may be changed from the fifth voltage level VINT_H to the fourth voltage level VINT_L, and then may be changed from the fourth voltage level VINT_L to the fifth voltage level VINT_H again. Thus, the voltage level of the third power source VINT may swing to initialize the first electrode of the OLED as the first voltage level ELVDD_L. Accordingly, a grayscale margin for representing a black grayscale may be enlarged and display quality may be improved.

During the emission period PB6, the first power source ELVDD may have the third voltage level ELVDD_H. The third power source VINT may have the fifth voltage level VINT_H. The second power source ELVSS may have the sixth voltage level ELVSS_L. The scan signal S[i] has an off-level. Thus, the driving current I_OLED may be generated according to the voltage difference between the gate electrode and the source electrode (e.g., the first electrode) of the first transistor T1. The driving current I_OLED may flow through the OLED from the first transistor T1, and then the pixels may simultaneously emit light.

The pixel may be driven in various methods instead of the method of FIG. 12. For example, as shown in FIG. 13, during the data writing period PB4, the first power source ELVDD may have the second voltage level ELVDD_M. The third power source VINT may have the fifth voltage level VINT_H. The second power source ELVSS may have the seventh voltage level ELVSS_H. The panel driver may progressively provide the scan signals S[1] through S[n] having an on-level to the scan lines, such that the data signals are programmed in the pixels.

Thus, unlike the method in FIG. 12, the method in FIG. 13 sets the voltage level of the first power source ELVDD to the second voltage level ELVDD_M during the data writing period PB4 and the third initialization period PB5, to prevent leakage current from the first power source ELVDD to the second node N2 via the first transistor T1 during the data writing period PB4. For example, the voltage of the first electrode of the first transistor T1 may be set to a voltage level (e.g., the second voltage level ELVDD_M) between the first voltage level ELVDD_L and the third voltage level ELVDD_H to remove the leakage current path. Accordingly, change of the data signal programmed in the pixel resulting from leakage current may be prevented, and thus display quality degradation (e.g., stain, defect, etc) resulting from luminance deviation between pixels may be prevented.

Figure 14:
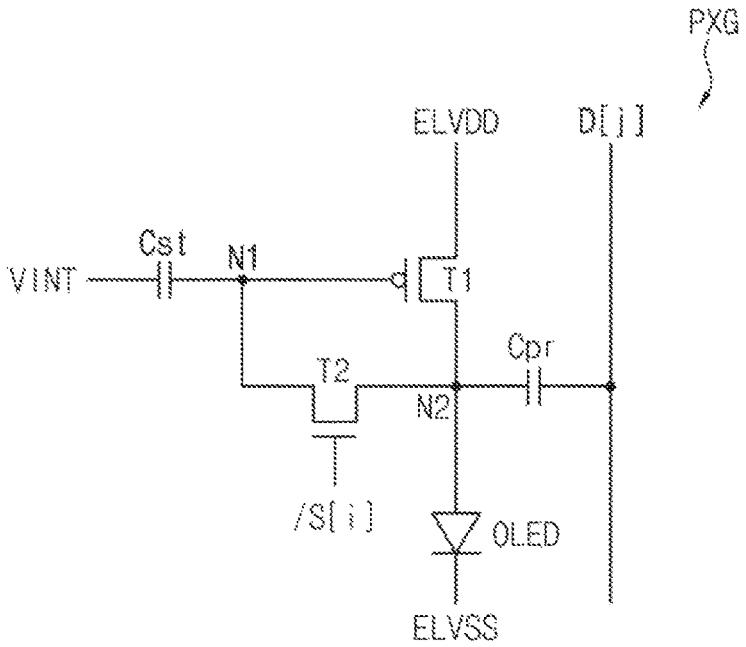
FIGS. 14 to 16 illustrate additional embodiments of a pixel.
Figure 15:
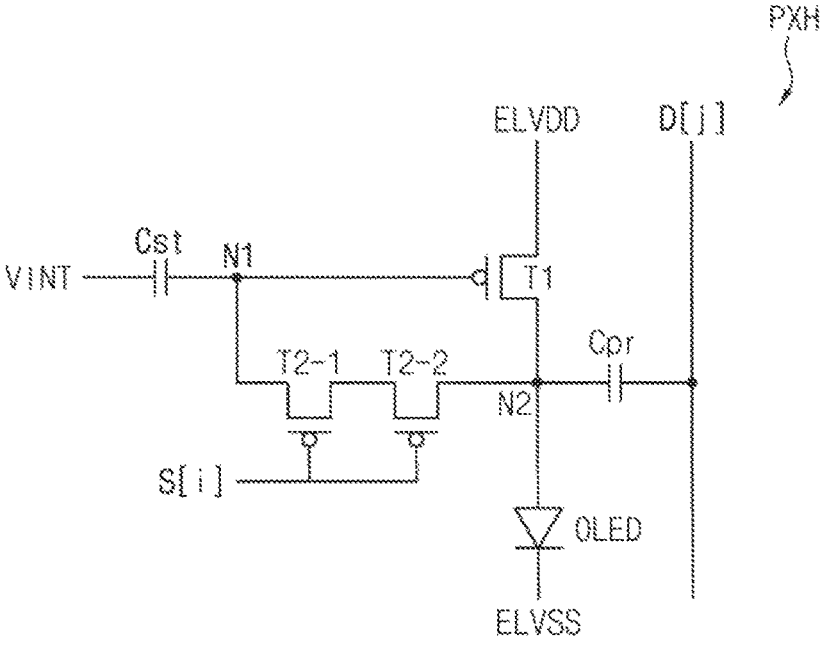
Figure 16:
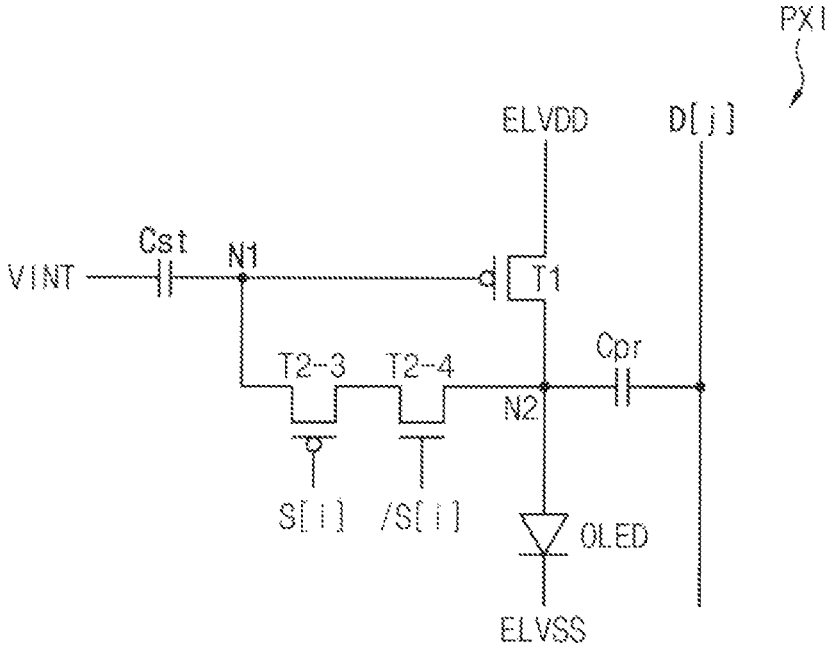

FIGS. 14 through 16 illustrate embodiments of pixels PXG, PXH, or PXI in the display device of FIG. 1. Referring to FIGS. 14 to 16, the pixel PXG, PXH, or PXI may include a first transistor T1, a second transistor T2, a first capacitor Cst, a second capacitor Cpr, and an OLED. The pixel PXG, PXH, or PXI may be substantially the same as the pixel PXF in FIG. 11, except that the second transistor is an nMOS transistor or dual transistor.

The first transistor T1 may be a driving transistor. In one example embodiment, the first transistor T1 may include a gate electrode connected to the first node N1, a first electrode connected to a first power source ELVDD, and a second electrode connected to the second node N2. The first transistor T1 may be a pMOS transistor.

The second transistor T2 may connect the gate electrode of the first transistor T1 to the second electrode of the first transistor T1 based on the scan signal.

In one example embodiment, as shown in FIG. 14, the first transistor T1 and the second transistor T2 in the pixel PXG may be different types of MOS transistors. For example, the first transistor T1 may be a pMOS transistor and the second transistor T2 may be an nMOS transistor. The second transistor T2 of the pixel PXG may connect the first node N1 to the second node N2 based on an inverted scan signal/S[i]. Because the nMOS transistor may generate less leakage current than a pMOS transistor in general, leakage current flowing from the first node N1 to the second node N2, via the second transistor T2, may be reduced.

In another example embodiment, as shown in FIGS. 15 and 16, the second transistor T2 in the pixel PXH or PXI may be implemented as dual transistor (e.g., two transistors connected to each other in series) to reduce leakage current. For example, like FIG. 15, the pixel PXH may include the (2-1)st transistor T2-1 and the (2-2)nd transistor T2-2 connected to each other in series and that connect the gate electrode of the first transistor T1 to the second electrode of the first transistor T1 based on the scan signal S[i]. In addition, like FIG. 16, the pixel PXI may include the (2-3)rd transistor T2-3 and the (2-4)th transistor T2-4 connected to each other in series and that connect the gate electrode of the first transistor T1 to the second electrode of the first transistor T1 based on the scan signal S[i] and the inverted scan signal/S[i].

The first capacitor Cst may include a first electrode connected to the third power source VINT and a second electrode connected to the first node N1.

The second capacitor Cpr may include a first electrode receiving the data signal D[j] from the (j)th data line and a second electrode connected to the second node N2.

The OLED may include a first electrode connected to the second node N2 and a second electrode connected to the second power source ELVSS.

The pixels PXG, PXH, or PXI in FIGS. 14 through 16 may be driven in substantially the same manner as the driving method in FIG. 12 or FIG. 13.

The display device in accordance with one or more of the aforementioned embodiments may be, for example, an organic light emitting display device or another type of display device. The pixels may be various combinations of oxide TFT and LTPS TFTs. In addition, the pixels may include transistors of nMOS transistors and/or pMOS transistors. Also, the embodiments described herein may be applied to an electronic device including the display device. Examples of the electronic device include but are not limited to a cellular phone, smart phone, smart pad, and personal digital assistant.

The methods, processes, and/or operations described herein may be performed by code or instructions to be executed by a computer, processor, controller, or other signal processing device. The computer, processor, controller, or other signal processing device may be those described herein or one in addition to the elements described herein. Because the algorithms that form the basis of the methods (or operations of the computer, processor, controller, or other signal processing device) are described in detail, the code or instructions for implementing the operations of the method embodiments may transform the computer, processor, controller, or other signal processing device into a special-purpose processor for performing the methods described herein.

The controllers, drivers, and other signal generating and signal processing features of the disclosed embodiments may be implemented in logic which, for example, may include hardware, software, or both. When implemented at least partially in hardware, the controllers, drivers, and other signal generating and signal processing features may be, for example, any one of a variety of integrated circuits including but not limited to an application-specific integrated circuit, a field-programmable gate array, a combination of logic gates, a system-on-chip, a microprocessor, or another type of processing or control circuit.

When implemented in at least partially in software, the controllers, drivers, and other signal generating and signal processing features may include, for example, a memory or other storage device for storing code or instructions to be executed, for example, by a computer, processor, microprocessor, controller, or other signal processing device. The computer, processor, microprocessor, controller, or other signal processing device may be those described herein or one in addition to the elements described herein. Because the algorithms that form the basis of the methods (or operations of the computer, processor, microprocessor, controller, or other signal processing device) are described in detail, the code or instructions for implementing the operations of the method embodiments may transform the computer, processor, controller, or other signal processing device into a special-purpose processor for performing the methods herein.

Example embodiments have been disclosed herein, and although specific terms are employed, they are used and are to be interpreted in a generic and descriptive sense only and not for purpose of limitation. In some instances, as would be apparent to one of ordinary skill in the art as of the filing of the present application, features, characteristics, and/or elements described in connection with a particular embodiment may be used singly or in combination with features, characteristics, and/or elements described in connection with other embodiments unless otherwise indicated. Accordingly, various changes in form and details may be made without departing from the spirit and scope of the embodiments set forth in the claims.

What is claimed is:

1. A pixel comprising:

a first transistor including a gate electrode connected to a first node, a first electrode that receives a first power voltage, and a second electrode connected to a second node;

a second transistor including a gate electrode that receives a scan signal, a first electrode connected to a first node, and a second electrode connected to a third node;

a third transistor including a gate electrode that receives a common control signal, a first electrode connected to the third node, and a second electrode connected to the second node;

an organic light emitting diode including a first electrode connected to the second node and a second electrode that receives a second power voltage;

a first capacitor including a first electrode that receives an initialization voltage and a second electrode connected to the first node; and a second capacitor including a first electrode that receives a data signal and a second electrode connected to the third node, wherein the initialization voltage swings between a first initialization voltage level and a second initialization voltage level that is lower than the first initialization voltage level during a period in which the first power voltage has a low voltage level, the second power voltage has a high voltage level, and the third transistor is in a turn-on state in response to the common control signal, and wherein the second transistor is switched, in response to the scan signal, from a turn-off state to a turn-on state during a period in which the initialization voltage has the second initialization voltage level.

2. The pixel as claimed in claim 1, wherein the initialization voltage swings between the first initialization voltage level and the second initialization voltage level during a period in which the first power voltage has the low voltage level, the second power voltage has a low voltage level, the second transistor is in the turn-off state in response to the scan signal, and the third transistor is in a turn-off state in response to the common control signal.

3. The pixel as claimed in claim 1, wherein the initialization voltage swings between the first initialization voltage level and the second initialization voltage level during a period in which the first power voltage has a high voltage level, the second power voltage has the high voltage level, the second transistor is in the turn-off state in response to the scan signal, and the third transistor is in a turn-off state in response to the common control signal.

4. The pixel as claimed in claim 1, wherein the second and third transistors are low temperature poly silicon (LTPS) thin film transistors.

5. The pixel as claimed in claim 4, wherein the second and third transistors are p-channel metal oxide semiconductor (pMOS) transistors.

6. The pixel as claimed in claim 1, wherein the second and third transistors are oxide thin film transistors.

7. The pixel as claimed in claim 6, wherein the second and third transistors are n-channel metal oxide semiconductor (nMOS) transistors.

8. The pixel as claimed in claim 1, wherein the second transistor is an LTPS thin film transistor, and the third transistor is an oxide thin film transistor.

9. The pixel as claimed in claim 1, wherein the second transistor is a pMOS transistor, and the third transistor is an nMOS transistor.

10. The pixel as claimed in claim 1, wherein the second transistor is an oxide thin film transistor, and the third transistor is an LTPS thin film transistor.

11. The pixel as claimed in claim 1, wherein the second transistor is an nMOS transistor, and the third transistor is a pMOS transistor.

12. The pixel as claimed in claim 1, wherein the first transistor is an LTPS thin film transistor.

13. The pixel as claimed in claim 12, wherein the first transistor is a pMOS transistor.

14. The pixel as claimed in claim 1, wherein the first transistor is an oxide thin film transistor.

15. The pixel as claimed in claim 14, wherein the first transistor is an nMOS transistor.

* * * * *